US005522463A

United States Patent [19]

Barbee

[11] Patent Number: 5,522,463

[45] Date of Patent: Jun. 4, 1996

[54] DOWNHOLE OIL WELL PUMP APPARATUS

[76] Inventor: Phil Barbee, P.O. Box 2005, Gretna, La. 70054-2005

[21] Appl. No.: 296,116

[22] Filed: Aug. 25, 1994

[51] Int. Cl.[6] ..... E21B 43/00

[52] U.S. Cl. ..... 166/68; 166/106; 417/394

[58] Field of Search ..... 166/68, 106, 105; 417/394, 478

[56] References Cited

U.S. PATENT DOCUMENTS

| | | | |
|---|---|---|---|
| 1,852,242 | 4/1932 | Holt | 417/394 X |
| 2,807,216 | 9/1957 | Bielstein | 417/394 |
| 2,931,309 | 4/1960 | Bower | 417/394 |
| 3,963,377 | 6/1976 | Elliott et al. | 417/394 X |
| 4,489,779 | 12/1984 | Dickinson | 166/64 |
| 4,810,172 | 3/1989 | Fiedler et al. | 417/394 |
| 4,886,432 | 12/1989 | Kimberblin | 417/478 |
| 5,211,242 | 5/1993 | Coleman et al. | 166/106 X |

OTHER PUBLICATIONS

Coiled Tubing Conference, Mar. 1993, Session 3:19. Single–Trip Gravel Pack System Used Effectively on a Highly Deviated Well.

*Primary Examiner*—Hoang C. Dang

*Attorney, Agent, or Firm*—Pravel, Hewitt, Kimball & Krieger

[57] ABSTRACT

A downhole oil well pump apparatus is useful for lifting oil from the lower end of production tubing adjacent the formation to the earth's surface. The apparatus includes a tool body that can be lowered into the oil well to a level that contains oil that is to be pumped. Packers are used to close off the tubing below the tool body. The tool body includes a bladder that flexes between expanded and contracted positions. The tool body includes a production channel for transmitting oil from the bladder to the earth's surface. Valves above and below the bladder control fluid flow from the bladder to the production channel. The bladder is driven with pressurized gas such as butane.

10 Claims, 3 Drawing Sheets

DOWNHOLE OIL WELL PUMP APPARATUS

BACKGROUND OF THE INVENTION

1. Field of the Invention

The present invention relates to pumps that are used in the secondary recovery of oil, namely recovery of oil that will not flow to the surface via downhole pressure. Even more particularly, the present invention relates to an improved downhole oil well pump that includes a flexible pumping member activated with hydrostatic pressure of liquified gas (such as, for example, butane) and a closed circuit flow path for the gas that includes a compressing step to recompress the butane to liquid form after it has been expanded to gaseous state following the pumping cycle of the pump.

2. General Background

In the pumping of oil from a downhole oil well environment, it has been known to use mechanical pumps such as rod pumps to lift oil to the earth's surface when that oil will not flow because of low formation pressure. Such pumps have been in use for years and are commercially available from a number of manufacturers such as Camco, Otis, Halliburton and others. These same manufacturers supply gas lift valves that can be used to "lift" oil from a sluggish well. Gas lift valves are valving structures that are positioned at vertically spaced intervals along the production tubing. They are activated at varying pressures, providing pressurized gaseous injection at various levels in the well to help urge the oil upwardly.

SUMMARY OF THE INVENTION

The present invention provides an improved oil pump apparatus for lifting oil to the earth's surface. The apparatus provides an improved method and apparatus for lifting oil to the earth's surface that would not otherwise flow freely because of lack of downhole pressure. The apparatus of the present invention includes an elongated tool body and a means for lowering the tool body into the well to a level that contains oil to be pumped. In the preferred embodiment, the lowering device can be a coil tubing unit.

A packer is provided for closing off the production tubing below the tool body.

The tool body includes a bladder that flexes between expanded and contracted positions.

The tool body includes a production channel for transmitting oil between the bladder and the earth's surface. Valves are provided above and below the bladder at the production channel to valve fluid flow. One valve allows oil into the bladder, a check valve allows oil to flow upwardly but closes to keep oil from reversing its flow.

A closed circuit, pressurized gas system is used to generate a flow differential for forcing the oil to be pumped upwardly.

In the preferred embodiment, the closed circuit pressurized gas system includes a delivery pipe that transmits liquified butane or liquified propane or the like downhole to the bladder. The liquified butane uses its own hydrostatic pressure to collapse the bladder forcing the oil upwardly through the production channel. A timer regulates transmission of the liquified butane downhole.

The apparatus of the present invention is unique in that it uses a hydrostatic head of liquified gas to help lift the oil in the well.

During placement, the apparatus of the present invention can be installed on coiled tubing without removing existing tubing.

The lifting fluid (for example propane or butane) is maintained in the coil tubing under enough pressure to keep it in liquid state.

The coil tubing annulus contains the liquid gas to be pumped. The production tubing or casing annulus contains low pressure gas returning to the surface. A compressor is used at the surface to recompress the gas to a liquid state so that is can provide enough hydrostatic pressure to lift the produced liquid.

Extremely high pressures are not required because the produced oil is not much heavier than liquid propane or butane unless there is a large amount of produced water.

Typical oil wells already have a tubing/annulus packer installed. If so, the packer is set with a standing valve in the tubing near the bottom. With the method of the present invention, a hole is punched in the tubing a known distance above the standing valve packer.

The user then runs another packer with the pump and sleeve valve spaced such that the punched hole is between the sleeve valve and the pump packer.

Water is displaced in the well with liquified gas such as propane, and the packer is set. The user then bleeds the tubing/casing annulus off until the well fluid expands the pump bladder. By increasing with coil pressure, the sleeve valve opens and directs the coil pressure to the outside of the bladder while sealing the punched hole. The bladder will then collapse forcing the well fluid (oil) up the coil/tubing annulus.

A timer is provided at the surface that will stop the pressure when the bladder is collapsed. A spring loaded pressure actuated ball valve on the bottom will support the hydrostatic pressure of the liquified propane.

The sleeve valve will close, venting the outside of the bladder to the tubing/casing annulus through the punched hole. Well fluid will then be exposed to low pressure and will fill the bladder. When this is completed, a surface timer will repressure the coil tubing and the cycle is repeated.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

DETAILED DESCRIPTION OF THE PREFERRED EMBODIMENT

Figure 1A:
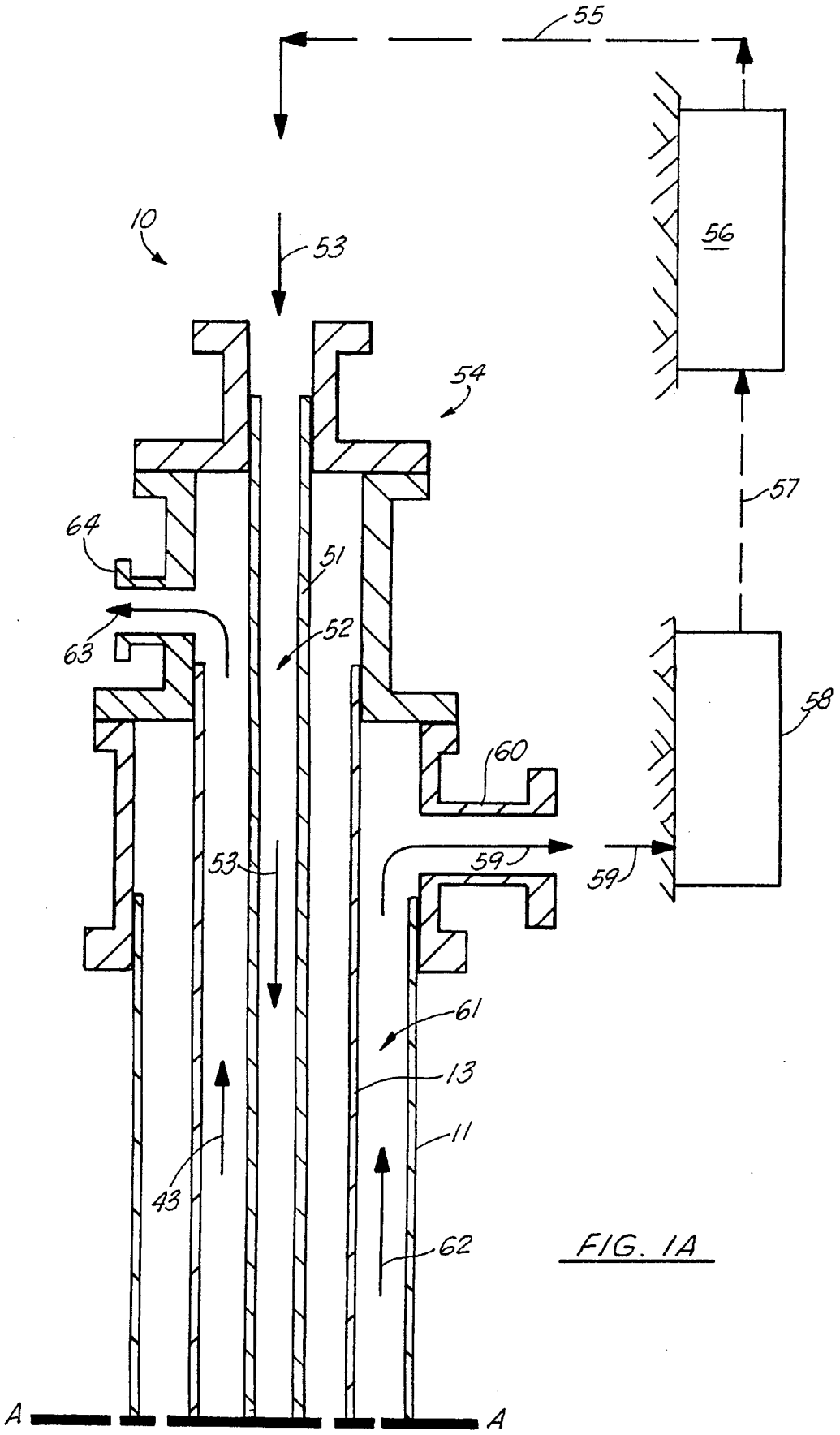
FIG. 1A–1C are sectional elevational views of the preferred embodiment of the apparatus of the present invention.

FIG. 1 illustrates the preferred embodiment of the apparatus of the present invention designated generally by the numeral 10. Oil well pump apparatus 10 is shown is FIG. 1 as disposed within the lower end of a typical downhole oil well casing 11. The cylindrically shaped casing 11 extends down into the surrounding formation 12 having oil to be pumped to the surface.

A production tubing 13 also extends down into the well, being concentrically positioned within the casing 11. A casing packer 14 is disposed at the lower end of the casing between the casing 11 and production tubing 13. The lower end of the casing 11 carries a plurality of perforations 16 that allow oil to flow into the lower end 15 of casing 11 via perforations 16. Arrows 17 in FIG. 1 schematically depict the flow path of oil from surrounding formation 12 through perforations 16 and into production tubing 13.

The lower end portion 18 of the production tubing 13 extends below the packer 14. Production tubing 13 has an internal bore 19. Tool body 20 is disposed within the production tubing bore 19 and extends slightly below the lower end 18 of production tubing 13.

Tool body 20 includes a lower cylindrical section 21. Section 21 provides a bore 22 that communicates with incoming oil, schematically shown as arrows 17. The oil entering casing 15 is prevented from flowing upwardly in casing 15 by packer 14. Oil is prevented from flowing upwardly in production tubing 18 bore 19 by packer 26. Thus, the incoming oil flows into bore 22 of lower tool body section 21. The oil flows upwardly, displacing ball 25 on valve seat 24 of check valve 23 and entering bore 30 of restricted diameter section 27 of tool body 20. In this position, the oil exits bore 30 of restricted diameter section 27 via a plurality of perforations 28 and filling flexible bladder 29. The flexible bladder 29 expands to the position shown in phantom lines in FIG. 1. The expanded position of bladder 29 (when filled with oil) is indicated by the numeral **29*b* in FIG. 1. The contracted position (prior to filling) is designated as 29*a***.

To pump oil from within bladder 29 (full position **29*b*), hydrostatic pressure in the form of liquified gas (e.g. butane or propane) is pumped downhole via bore 52 of gas delivery line 51 (see arrows 53, FIG. 1). Gas delivery line 51 can be coil tubing of a coil tubing unit (commercially available). The coil tubing can also be used to place the tool body 20 in the well. The liquified gas produces a hydrostatic head that transmits pressure via line 45 to sleeve valve 34, opening flexible sleeve 35 and depressing the external surface of bladder 29. This hydrostatic head collapses bladder 29 and forces oil within bladder 29 to flow upwardly (see arrows 41, 43, 63) to oil exit port 64**.

A timer (located at the well surface area) is preferably used to stop the pressure acting on bladder 29 once the bladder 29 has collapsed. At that time, spring loaded pressure actuated ball valve 47 will support the hydrostatic pressure of the liquified gas (i.e. butane or propane). Sleeve valve 34 will close when pumping stops, venting gas on the outside of bladder 29 to the casing annulus via opening 39. Well fluid (i.e. oil to be pumped) will be exposed to this low pressure and will then fill the bladder 29 again. When this is done, the surface timer will repressure the delivery line 51 and the cycle repeats.

Check valve body 31 includes a valve seat 32 for receiving ball 33. During a pumping of oil and a collapsing of bladder 29, ball 33 closes check valve body 31 by seating against valve seat 32.

Sleeve valve body 34 defines a central section of tool body 20, positioned above restricted diameter section 27 of tool body 20. Sleeve valve body 34 carries a cylindrically shaped flexible sleeve 35 that includes an attached portion 36 and a moving portion 37. When liquid butane is pumped (see arrow 53) downhole via delivery tube 51, it opens the moving portion 37 of flexible sleeve 35 so that the hydrostatic head of liquid butane (or like liquid gas) flows through flow openings 50 and engages the outside surface of bladder 29, causing bladder 29 to collapse to the position shown in hardlines and designated as **29*a***.

Delivery tube 51 communicates with cylindrical section 38 of tool body 20. As part of the method of the present invention, a flow opening 39 is formed in the well production tubing 13 adjacent sleeve valve body 34. An upper tubing packer 40 is placed between cylindrical tool body section 38 and sleeve valve body 34 as shown in the drawing. When the pump 56 stops pumping liquid butane downhole via delivery tube 51, spring 48 closes ball valve 47 by forcing ball valve 47 against valve seat 46.

Coil spring 48 extends between ball 47 and annular shoulder 49. When this occurs, the sleeve moving portion 37 collapses against openings 50 and the butane below packer 40 exits via flow opening 39 into casing annulus above packer 14 that flow zone being indicated by the arrow 62 as a return flow path for butane gas.

Valve tree 54 includes flow outlet 60 for vaporized butane gas returning to compressor 58 and pump 56. Oil exit port 64 delivers the production of oil from the well. Pump 56 is schematically shown in FIG. 1 as transmitting liquified gas under pressure via flow line 55 to liquid delivery tube 51. Compressor 58 receives butane (gaseous phase) via flow outlet 60 as schematically indicated by the arrows 59. Flow line 57 transmits liquid butane from compressor 58 to pump 56 after it has been changed from gaseous phase to liquid phase.

With the method of the present invention, pump 56 transmits liquified gas such as butane, propane, or like via line 55 to pump delivery tube 51. The liquid butane defines a hydrostatic head that opens valve 47 and exerts pressure on bladder 29 that has been filled with oil to be pumped. The pressure exerted on bladder 29 also closes ball 25 against seat 24 preventing the reverse flow of oil from within bladder 29 to the lower end of 21 of the tool body 20. A timer can be used to run the pump 56 for a desired time interval based upon the rate at which oil is entering bladder 29, the size of bladder 29, and the size of the flow channels leading to and from bladder 29.

When the pump 56 is stopped by the timer, valve 47 closes and the gas below valve 47 transfers from liquid to gaseous phase as it exits port 39. Returning gaseous phase butane or propane travels through annulus 61 (see arrows 62) to compressor 58 where the gaseous phase butane or propane is recompressed to liquid phase and transferred via line 57 to pump 56. The cycle can thus be controlled by alternating the pump 56 between pumping (on) and non-pumping (off) timed cycles.

Figure 1B:
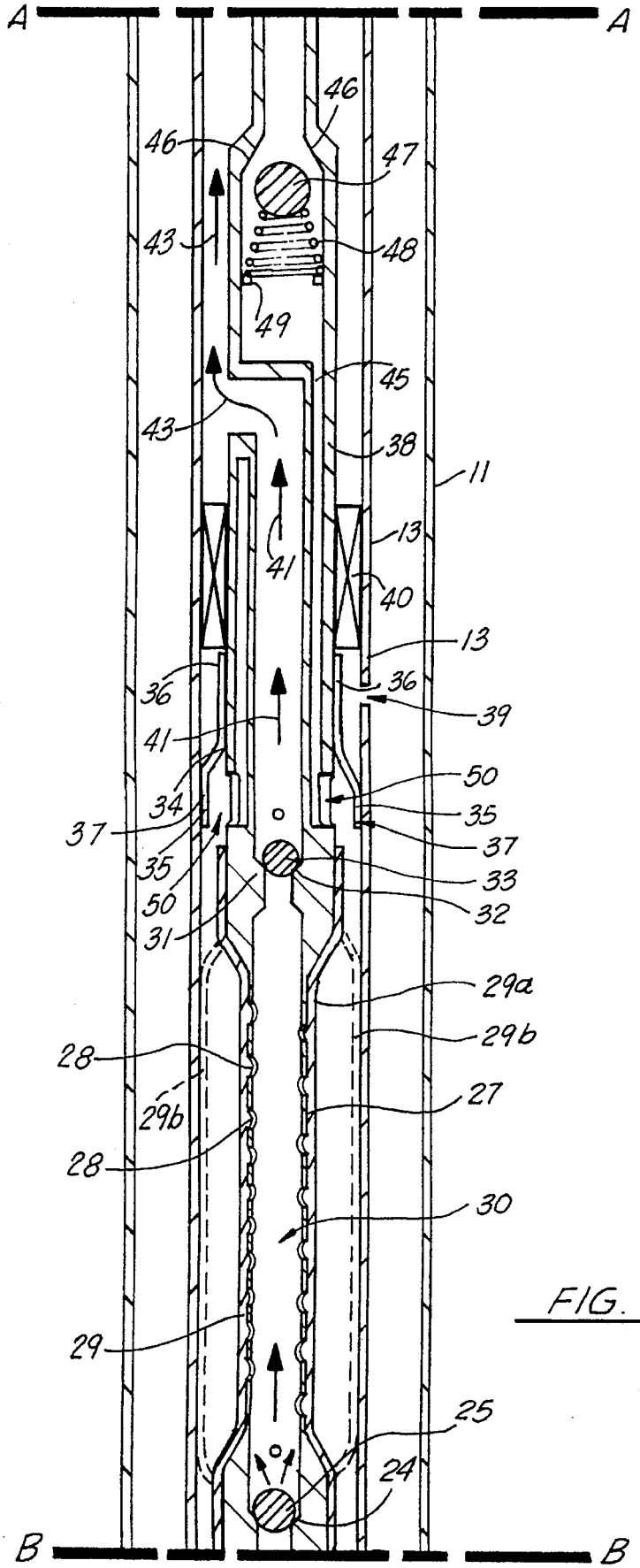
Figure 1C:
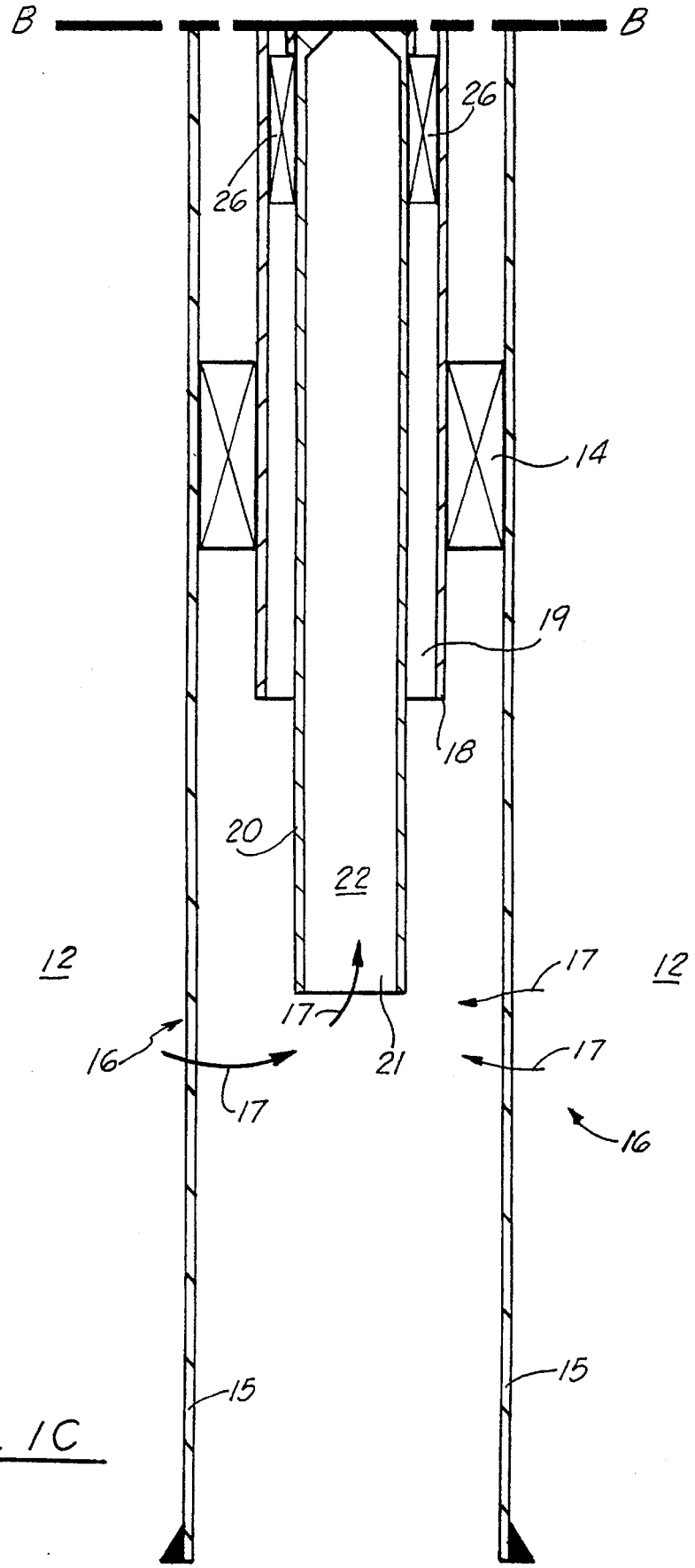

Because the apparatus 10 of the present invention is an elongated structure, the sectional view of the apparatus 10 has been split into three drawing sheets as FIGS. 1A, 1B, and 1C. Match lines A—A on FIGS. 1A and 1B shows that the bottom of FIG. 1A and 1B shows that the bottom of FIG. 1A matches the top of Figure 1B. Similarly, the bottom of FIG. 1B matches the top of FIG. 1C at match lines B—B.

The following table lists the parts numbers and parts descriptions as used herein and in the drawings attached hereto.

PARTS LIST

| Part Number | Description |
|---|---|
| 10 | oil well pump |
| 11 | casing |
| 12 | formation |
| 13 | production tubing |
| 14 | casing packer |
| 15 | lower end of casing |
| 16 | perforations |

-continued

PARTS LIST

| Part Number | Description |
|---|---|
| 17 | arrows |
| 18 | lower end of tubing |
| 19 | tubing bore |
| 20 | tool body |
| 21 | lower cylindrical section |
| 22 | tool body bore |
| 23 | check valve body |
| 24 | valve seat |
| 25 | ball |
| 26 | packer |
| 27 | restricted diameter section |
| 28 | perforations |
| 29 | flexible bladder |
| 30 | bore |
| 31 | check valve body |
| 32 | valve seat |
| 33 | ball |
| 34 | sleeve valve body |
| 35 | flexible sleeve |
| 36 | attached portion |
| 37 | moving portion |
| 38 | cylindrical section |
| 39 | flow opening |
| 40 | upper tubing packer |
| 41 | arrows |
| 42 | lateral channel |
| 43 | arrow (production) |
| 44 | relief valve body |
| 45 | vertical channel |
| 46 | valve seat |
| 47 | ball |
| 48 | coil spring |
| 49 | annular shoulder |
| 50 | flow opening |
| 51 | liquified gas delivery tube |
| 52 | bore |
| 53 | arrow |
| 54 | valve tree |
| 55 | flow line |
| 56 | pump |
| 57 | flow line |
| 58 | compressor |
| 59 | arrow |
| 60 | flow outlet |
| 61 | annulus |
| 62 | arrow |
| 63 | flow line |
| 64 | oil exit port (production) |

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A downhole oil well pump apparatus for use in pumping oil from a downhole oil well comprising:

a) an elongated tool body having an upper end portion, a lower end portion and an internal flow bore;

b) means for supporting the tool body in a section of oil well production casing adjacent a formation having oil to be pumped;

c) packer means positioned between the tool body and production casing for preventing fluid flow between the tool body and the production casing at the lower end portion of the tool body;

d) the lower end portion of the tool body defining a flow inlet that communicates with the tool body bore, for receiving oil to be pumped;

e) the flow bore that extending substantially the length of the tool body and including a central section having openings that allow fluid to flow into and out of the tool body bore at the openings;

f) annular bladder means surrounding the tool body at the openings for pumping fluid contained within the bore at the openings to a position in the tool body bore above the openings;

g) first valve means positioned on the tool body below the openings for preventing reverse flow of fluid in the tool bore to a position below the first valve means;

h) second valve means positioned above the first valve means and above the openings for preventing the reverse flow of fluid from a position in the tool body bore above the second valve means to a position below the second valve means;

i) liquified gas delivery means for forming a hydrostatic head of liquified gas above tool body, said gas delivery means including a pump and a stream of liquified gas that can be transmitted from the pump to the tool body bore at a position above the second valve means;

j) third valve means mounted in the tool body including a valving member that moves between open and closed flow positions, and wherein in the open position, the hydrostatic head of liquified gas communicates with the external surface of the bladder means to collapse the bladder means against the openings.

2. The apparatus of claim 1 wherein the tool body includes a lower section having an open bore, a central section having a plurality of perforations that extend between the tool body bore and the external surface thereof; and an upper tool body section.

3. The apparatus of claim 1 further comprising means for enabling the liquified gas to shift phases to a gaseous phase after the bladder means has been fully collapsed.

4. The apparatus of claim 1 further comprising a compressor communicating with the pump for compressing gaseous phase gas material to liquid phase gas material; and means for transmitting said liquid gas material to the pump.

5. The apparatus of claim 1 further comprising valve tree means positioned at the earth's surface for valving the flow of oil produced from the well.

6. A downhole oil well pump apparatus for use in pumping oil from a downhole oil well comprising:

a) an elongated tool body having an upper end portion, a lower end portion and an internal flow bore;

b) means for supporting the tool body in a section of oil well production tubing adjacent a formation having oil to be pumped;

c) packer means positioned between the tool body and production casing for preventing fluid flow between the tool body and the production casing at the lower end portion of the tool body;

d) the lower end portion of the tool body defining a flow inlet that communicates with the tool body bore, for receiving oil to be pumped;

e) the flow bore that extending substantially the length of the tool body and including a central section having openings that allow fluid to flow into and out of the tool body bore at the openings;

f) annular bladder means surrounding the tool body at the openings for pumping fluid contained within the bore at the openings to a position in the tool body bore above the openings;

g) first valve means positioned on the tool body below the openings for preventing reverse flow of fluid in the tool bore to a position below the first valve means;

h) second valve means positioned above the first valve means and above the openings for preventing the reverse flow of fluid from a position in the tool body bore above the second valve means to a position below the second valve means;

i) liquified gas delivery means for forming a hydrostatic head of liquified gas above tool body, said gas delivery means including a pump and a stream of liquified gas that can be transmitted from the pump to the tool body bore at a position above the second valve means;

j) third valve means including a valving member that moves between open and closed flow positions, and wherein in the open position, the hydrostatic head of liquified gas communicates with the external surface of the bladder means to collapse the bladder means against the openings wherein the delivery means comprises:

a pump for transmitting liquified gas into the well;

liquid gas delivery tube that extends from the pump to the tool body;

a return flow line that collects gaseous phase gas after the liquid gas has been used to pump oil from the well; and a compressor for recompressing gaseous phase gas into liquid gas and for transmitting same to the pump.

7. The apparatus of claim 1 wherein the tool supporting means is a coil tubing unit.

8. A downhole oil well pump apparatus for use in pumping oil from a downhole oil well comprising:

a) an elongated tool body having an upper end portion, a lower end portion and an internal flow bore;

b) means for supporting the tool body in a section of oil well production tubing adjacent a formation having oil to be pumped;

c) packer means positioned between the tool body and production casing for preventing fluid flow between the tool body and the production casing at the lower end portion of the tool body;

d) the lower end portion of the tool body defining a flow inlet that communicates with the tool body bore, for receiving oil to be pumped;

e) the flow bore that extending substantially the length of the tool body and including a central section having openings that allow fluid to flow into and out of the tool body bore at the openings;

f) annular bladder means surrounding the tool body at the openings for pumping fluid contained within the bore at the openings to a position in the tool body bore above the openings;

g) first valve means positioned on the tool body below the openings for preventing reverse flow of fluid in the tool bore to a position below the first valve means;

h) second valve means positioned above the first valve means and above the openings for preventing the reverse flow of fluid from a position in the tool body bore above the second valve means to a position below the second valve means;

i) liquified gas delivery means for forming a hydrostatic head of liquified gas above tool body, said gas delivery means including a pump and a stream of liquified gas that can be transmitted from the pump to the tool body bore at a position above the second valve means;

j) third valve means including a valving member that moves between open and closed flow positions, and wherein in the open position, the hydrostatic head of liquified gas communicates with the external surface of the bladder means to collapse the bladder means against the openings wherein the third valve means includes a sleeve valve having a valve body, a sleeve disposed about the valve body, flow openings in the valve body, and a portion of the sleeve flexes between open and closed flow positions, the sleeve covering the flow openings in the closed flow position.

9. The apparatus of claim 1 wherein the bladder means is a flexible bladder that extends around the tool body.

10. A downhole oil well pump apparatus for use in pumping oil from a downhole oil well bore to the oil well surface area comprising:

a) an elongated tool body having an upper end portion, a lower end portion and an internal flow bore;

b) means for supporting the tool body in a section of oil well production tubing adjacent a formation having oil to be pumped to the oil well surface area;

c) packer means positioned between the tool body and production casing for preventing fluid flow between the tool body and the production casing at the lower end portion of the tool body;

d) the lower end portion of the tool body defining a flow inlet that communicates with the tool body bore, for receiving oil to be pumped;

e) the flow bore that extending substantially the length of the tool body and including a central section having openings that allow fluid to flow into and out of the tool body bore at the openings;

f) a downhole pump having a pump chamber positioned at tool body openings for pumping fluid contained within the bore at the openings to a position in the tool body bore above the openings, the pump having a pumping member that moves between filled and unfilled positions;

g) liquified gas delivery means for forming a hydrostatic head of liquified gas above tool body, said gas delivery means including a liquified gas pump and a stream of liquified gas that can be transmitted from the gas pump to the tool body bore at a position above pumping member;

h) wherein the hydrostatic head of liquified gas communicates with the downhole pump at intervals to move the pumping member from the filled to the unfilled position using hydrostatic pressure;

i) wherein in the filled position, the pump chamber expands with oil from the surrounding formation and in the unfilled position, the pump chamber contracts to discharge contained oil; and j) wherein the liquified gas is shifted from a liquid to a gas phase by discharging the gas into the well annulus defined between the production tubing and production casing after the pumping member reaches the unfilled position.

* * * * *